US005559298A

United States Patent [19]

Okamoto

[11] Patent Number: 5,559,298

[45] Date of Patent: Sep. 24, 1996

[54] WAVEFORM READ-OUT SYSTEM FOR AN ELECTRONIC MUSICAL INSTRUMENT

[75] Inventor: Seiji Okamoto, Shizuoka-ken, Japan

[73] Assignee: Kabushiki Kaisha Kawai Gakki Seisakusho, Japan

[21] Appl. No.: 321,154

[22] Filed: Sep. 29, 1994

[30] Foreign Application Priority Data

Oct. 13, 1993 [JP] Japan ..... 5-278851
Oct. 13, 1993 [JP] Japan ..... 5-278852

[51] Int. Cl.[6] ..... G10H 1/02; G10H 1/06; G10H 7/12

[52] U.S. Cl. ..... 84/607; 84/622; 84/626

[58] Field of Search ..... 84/603–607, 622–633

[56] References Cited

U.S. PATENT DOCUMENTS 4,348,929 9/1982 Gallitzendörfer ..... 84/607
5,185,491 2/1993 Izumisawa et al. ..... 84/627
5,308,916 5/1994 Murata et al. ..... 84/603
5,367,118 11/1994 Iwaooji ..... 84/604
5,451,710 9/1995 Shimizu ..... 84/622

*Primary Examiner*—Stanley J. Witkowski
*Attorney, Agent, or Firm*—Andrus, Sceales, Starke & Sawall

[57] ABSTRACT

An electronic musical instrument produces musical tones based on waveform data, while providing smooth changes between different timbres and at the same time avoiding reduction in the efficiency of waveform compression. The timbre change is carried out in an interpolation interval, the magnitude of which varies in accordance with the magnitude of the timbre change. The data necessary to establish the interpolation interval may be stored and read out of a memory or may be determined by interpolation according to a linear function.

8 Claims, 11 Drawing Sheets

$$t_1 = t_0 + n_0$$
$$t_2 = t_1 + n_1$$
$$t_3 = t_2 + n_2$$

WAVEFORM READ-OUT SYSTEM FOR AN ELECTRONIC MUSICAL INSTRUMENT

BACKGROUND OF THE INVENTION

1. Field of the Invention

The present invention relates to an electronic musical instrument that employs waveform interpolation to produce naturally sounding synthesized musical tones.

2. Description of the Related Art

At present there are various types of electronic musical instruments whose performance duplicates, as nearly as is possible, or even exceeds that of natural musical instruments.

Such electronic musical instruments generally have tone generation systems for the production of musical tones that correspond to notes.

To provide the profusion of expressive sounds that are available with natural musical instruments, most of the musical tones that these electronic musical instruments produce can be given a variety of timbres by superimposing harmonics, as necessary, on the basic waveforms that correspond to individual notes.

A tone generation system that is employed for this purpose stores waveforms in a read only memory (hereafter referred to as a "ROM"). Following the selection of a note by the manipulation of switches or keys at a panel or a keyboard, the waveform that corresponds to the selected note is read from an address that is specified by a central processing unit (hereafter referred to as a "CPU"). The waveform is then amplified, and after a D/A conversion is performed, the converted waveform is output as an acoustic signal.

When, in the above described manner, the waveforms stored in the waveform ROM are read sequentially, and multiple read-out waveforms whose timbres differ are output to produce a desired musical tone, the timbres are changed drastically and a discontinuous, unnatural sound is produced.

For example, the waveform for an attenuated tone tends first to provide a drastic timbre change at the beginning of tone production, and then to gradually change until it has become a stationary waveform. If waveform data that correspond to the stages of such timbre changes are stored in a ROM and are extracted sequentially, a naturally sounding musical tone cannot be provided.

In an effort to preclude the production of unnatural musical tones, electronic musical instruments have been constructed that perform a crossfade by altering timbres, at constant time intervals, so as to smoothly change from one timbre, i.e., waveform, to another.

A crossfade is a process that provides a smooth exchange of timbres by performing a fade-out effect, which involves the gradual weakening of a preceding timbre, and a fade-in effect, which involves the gradual strengthening of a succeeding timbre, while partially overlapping the two effects.

In certain systems that employ conventional techniques to change timbres at a constant time interval, however, the timing for waveform switching is fixed. Therefore, when the switching time interval is long, much of the waveform change data are lost if there is a drastic timbre change.

When the switching time interval is short, a system can cope with drastic timbre changes; but when a timbre change is performed gradually, the efficiency of waveform compression is degraded and the System does not function economically.

In those systems that change timbres within variable time periods, a storage means is required to hold the data that are employed to determine the timing for the waveform switching.

A ROM is generally employed as such a storage means; however, accessing the ROM and reading the necessary data require much time.

SUMMARY OF THE INVENTION

To overcome the enumerated shortcomings, it is an object of the present invention to provide an electronic musical instrument having an uncomplicated tone generator that can cope with natural-sounding, rich timbre changes, and that can so perform waveform interpolation that there is no degradation of waveform compression efficiency.

To achieve the above object, according to a first embodiment of the present invention, as shown in FIG. 1, an electronic musical instrument, which, to produce a desired musical tone, has waveform storage means for storing an optional number of sets of waveform data, which sequentially reads the waveforms that correspond to timbres that are suitable for immediate playing requirements, and which smoothly exchanges waveforms by performing a crossfade with a preceding waveform and a succeeding waveform, comprises: a tone generation system, which has an interpolation interval storage means for storing interval data for interpolation between the waveforms that correspond to timbre changes, for performing interpolation between the waveforms in consonance with the interval data read from the interpolation interval storage means.

According to a second embodiment of the present invention, as shown in FIG. 7, an electronic musical instrument, which, to produce a desired musical tone, has waveform storage means for storing an arbitrary number of sets of waveform data, which sequentially reads the waveforms that correspond to timbres that are suitable for immediate playing requirements, and which smoothly exchanges waveforms by performing a crossfade involving a preceding waveform and a succeeding waveform, comprises: a tone generation system for determining, according to the linear principle, interpolation intervals between the waveforms that correspond to timbre changes, and for, during tone production, performing interpolation between the waveforms at determined time intervals.

An electronic musical instrument according to the first embodiment includes a tone generation system that has a ROM for storing waveform data that correspond to a desired number of timbres. The electronic musical instrument can read, from the interpolation interval storage means, a waveform interpolation interval that corresponds to the magnitude of a change for a required timbre and can alter a waveform as needed, in consonance with the read-out interpolation interval data, while performing interpolation between the waveforms.

An electronic musical instrument according to the second embodiment includes a tone generation system that has a ROM for storing waveform data that correspond to a desired number of timbres. In correspondence with the magnitude of the change for a required timbre, the electronic musical instrument can calculate a waveform interpolation interval, according to the linear principle, and can alter the waveform as needed, in consonance with the determined interpolation interval, while performing interpolation between the waveforms.

Thus, as an electronic musical instrument of the present invention provides smooth timbre changes by employing short time intervals when there are drastic timbre changes, and long time intervals when there are gradual timbre changes, a relatively uncomplicated configuration can be employed to attain the above described object.

DETAILED DESCRIPTION OF THE PREFERRED EMBODIMENTS

Figure 1:
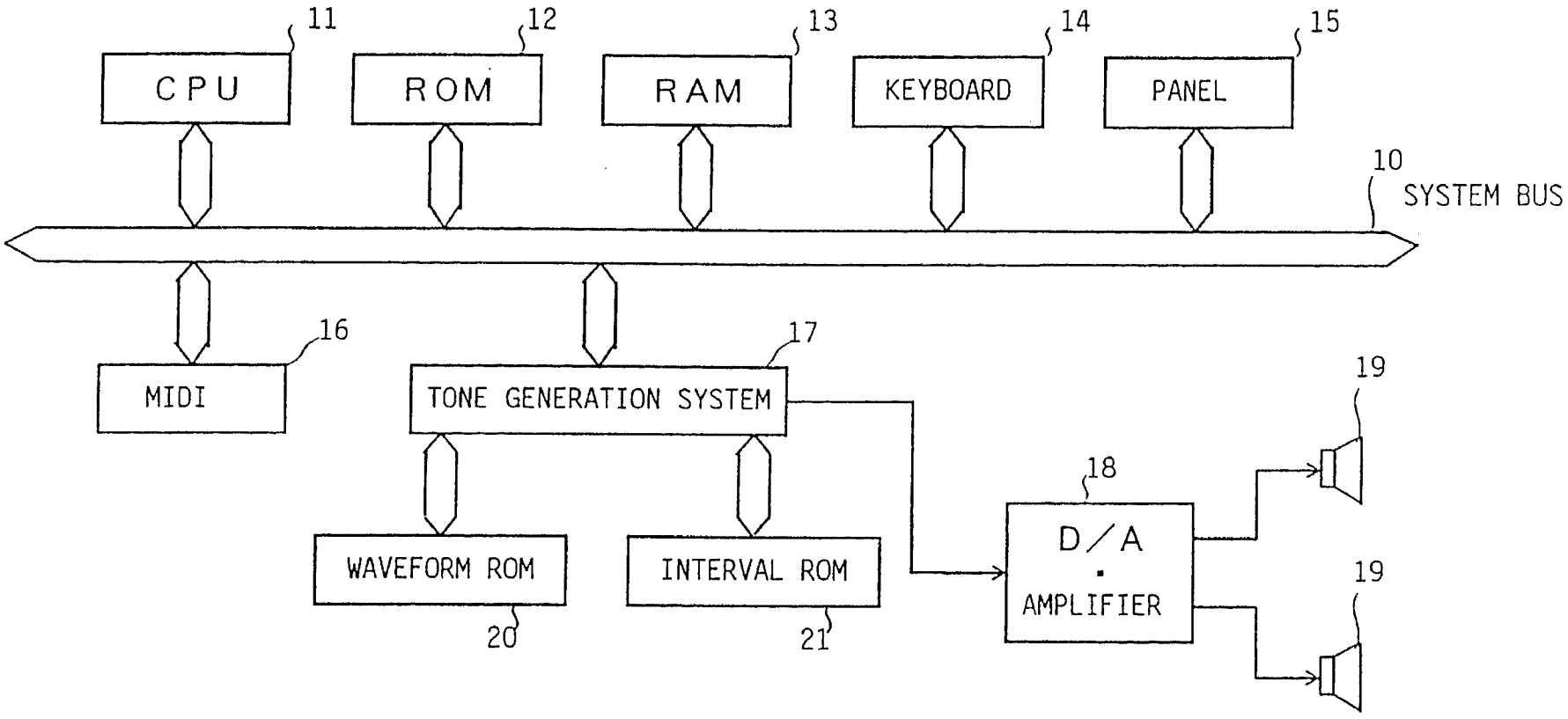
FIG. 1 is a schematic block diagram illustrating a first embodiment of an electronic musical instrument according to the present invention.

FIG. 1 is a schematic block diagram illustrating the general structure of a first embodiment of an electronic musical instrument having a tone generation system that can perform waveform interpolation at variable time intervals.

In the electronic musical instrument, a central processing unit (hereafter referred to as a "CPU") 11, a program ROM 12 for storing a control program, a random access memory (hereafter referred to as a "RAM") 13, a keyboard 14, an operation panel 15, an MIDI (Musical Instrument Digital Interface) 16, and a tone generation system 17 are mutually connected by a system bus 10.

The system bus 10 consists of, for example, an address bus, a data bus, and a control signal bus, and relays the signals that are exchanged by the connected components.

Loudspeakers 19 are connected to the tone generation system 17 via a digital/analog converter and amplifier (DA, AMP) 18. In addition, a primary ROM 20, which is used to store multiple waveforms, and a secondary ROM 21, which is used to store interpolation interval data, are connected to the tone generation system 17.

The CPU 11, while referring to the contents of the RAM 13, employs a control program that is stored in the program ROM 12 to control the entire electronic musical instrument.

For example, presuming that the panel 15 has previously been set up, the CPU 11 fetches a key-ON signal or key-OFF signal from the keyboard 14, and employs the data to acquire a key number and touch data for a key where an event has occurred.

Based on these data, the CPU 11 reads a tone generation parameter from the program ROM 12 and transmits it to the tone generation system 17, so that a musical tone that matches the playing conditions, such as a predetermined timber and a pitch, is produced.

The panel 15, which is connected to the CPU 11, serves as a part of a setup means for various coefficients and as a means for inputting playing condition instructions, etc. The MIDI 16 serves as an interface to exchange digital music data with another electronic musical instrument or an external computer.

In the program ROM 12 various fixed data that the CPU 11 requires are stored in addition to the control program for the CPU 11. In the ROM 12, tone generation parameters for generating musical tones with predetermined timbres are stored.

The tone generation parameters, which are provided for each timbre and each tone range, include a waveform address, frequency data, envelope data, a filter coefficient, etc.

The RAM 13 is used to temporarily store various data that the CPU 11 handles. Also defined in the RAM 13 are various registers, counters, and flags that are employed to control the electronic musical instrument.

Basic waveforms for musical tones that are to be produced are stored in the primary ROM 20, which is connected to the tone generation system 17. Thus, this ROM 20 is also called a waveform ROM 20.

In the tone generation system 17, to produce a musical tone the waveform data that correspond to the musical tone to be produced are converted into electric signals, and pulse code modulation is performed on a tone signal that is obtained via a predetermined filter.

In the primary ROM 20, multiple types of waveform data that correspond to individual keyboard keys and individual timbres are stored to provide multiple timbre types.

The waveform data stored in the primary ROM 20 are read out by the tone generation system 17. Musical tones can be sequentially produced by performing a looping process on the waveform data.

The tone generation system 17 is a circuit that has, for example, multiple oscillators. Upon receipt of a tone generation parameter and a tone production start command from the CPU 11, the tone generation system 17 reads out the waveform data stored in the primary ROM 20, performs waveform interpolation and envelope processing on the read-out waveform data, and generates a digital tone signal.

The output of the tone generation system 17 is transmitted via the digital/analog converter and amplifier 18 to the loudspeakers 19, which function as a reproduction unit. During its transmission, the output of the tone generation system 17 is converted into an analog signal, which is then amplified to a desired level. The resultant signal is output as an acoustic signal by the loudspeakers 19.

The secondary ROM 21, a storage means which is connected to the tone generation system 17, holds the optimal interpolation interval data that are used to perform waveform interpolation in consonance with the magnitudes of waveform changes. Thus, this ROM 21 is also called an interval ROM 21.

Under the control of the CPU 11, the interpolation interval data are read from the secondary ROM 21 and transmitted to the tone generation system 17. At the tone generation system 17, the interpolation interval data are used to perform optimal waveform interpolations in consonance with the changes in waveform data, i.e., the magnitudes of timbre changes, that are read from the primary ROM 20.

The following explanation will mainly cover a waveform interpolation process for the electronic musical instrument having the above described arrangement.

Figure 2:
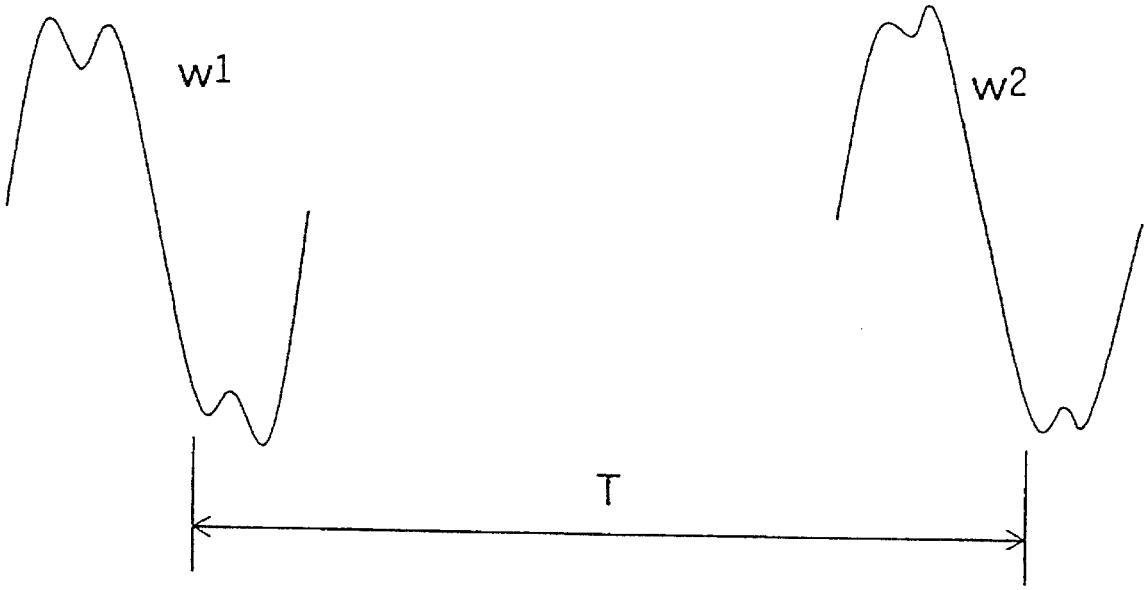
FIG. 2 is an explanatory diagram for the contents of a waveform ROM of the first embodiment of an electronic musical instrument according to the present invention.

FIG. 2 is an explanatory diagram showing the stages of waveform interpolation, which is the subject of the present invention. The preceding wave W1 and the succeeding wave W2, which are stored in the waveform ROM 20, have different forms and timbres.

Since the forms of the preceding wave W1 and the succeeding wave W2 are different, a naturally sounding musical tone will not be produced unless interpolation is performed between the waves. To provide a smooth wave shift, waveform interpolation must be performed within the time period represented by interpolation interval data T.

Figure 3:
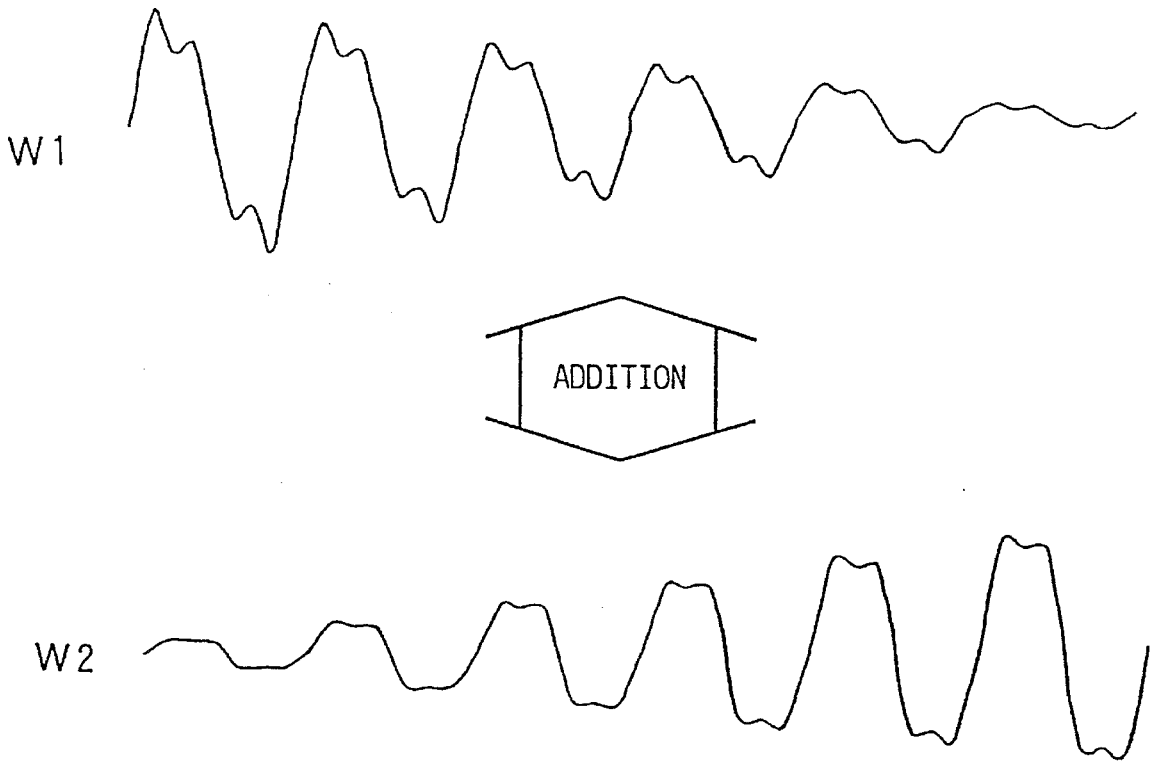
FIG. 3 is an explanatory diagram for the performance of a crossfade involving a preceding waveform and a succeeding waveform.

FIG. 3 is a diagram showing a crossfade wave shift during which a preceding wave W1 is replaced by a succeeding wave W2.

While the preceding wave W1 is undergoing fade-out and the succeeding wave W2 is simultaneously undergoing fade-in, the two waves, W1 and W2, are added together to provide a smooth shift from the preceding wave W1 to the succeeding wave W2.

Figure 4:
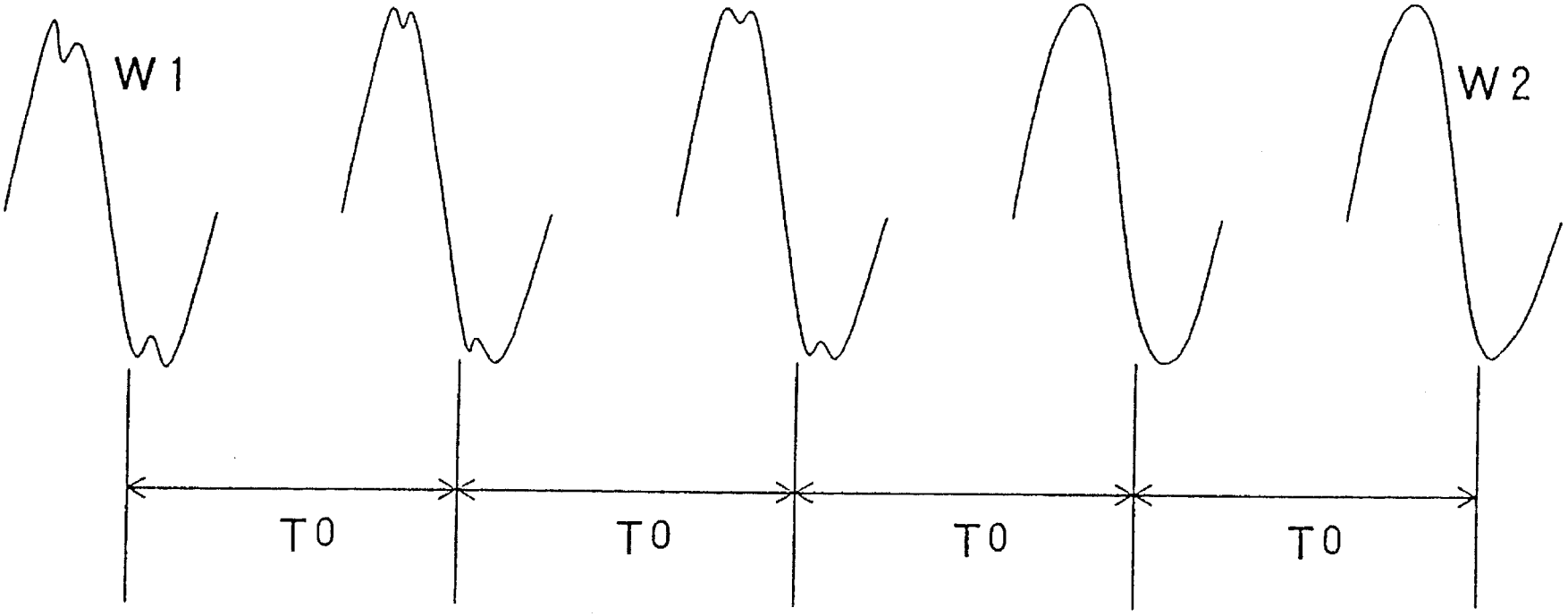
FIG. 4 is an explanatory diagram showing the interpolation stages between waveforms for a conventional system.

Conventionally, waveform interpolation is performed by using only a constant interpolation interval T0, as is shown in FIG. 4.

The conventional technique, which uses only the constant interval T0 during interpolation, does not include the use of a storage means such as the secondary ROM (interval ROM) 21 that is employed in the present invention. When a wave change includes a large timbre change, as is described above, there is a substantial loss of waveform change data and faithful production of a musical tone is difficult.

Then, when a timbre change is gradual, the waveform interpolation interval will be too large and the waveform compression effect will be reduced.

Figure 5:
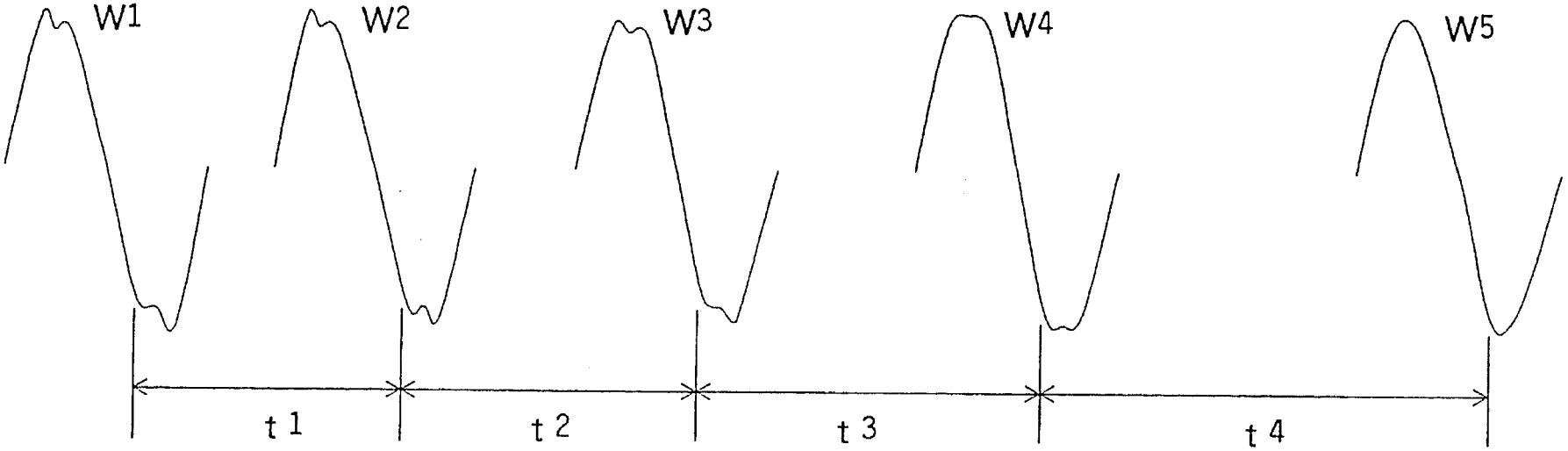
FIG. 5 is an explanatory diagram showing the interpolation stages between waveforms for the embodiment of the electronic musical instrument of the present invention.

FIG. 5 shows the stages of waveform interpolation according to the present invention. As the waveform data read from the waveform ROM 20 are progressively changed from W1, to W2, to W3, to W4, and to W5, the interpolation interval data are likewise changed from t1, to t2, to t3, and to t4. Each of the interval data has a different value.

The values held by interpolation interval data are therefore changed in consonance with the magnitudes of the timbre changes.

More specifically, predetermined values are stored in the interval ROM 21. Addresses are selected in consonance with differences between the values of the preceding and the succeeding waveform data W1, W2, W3, W4, and W5. Interval data tn that correspond to the selected addresses are read from the interval ROM 21.

Figure 6:
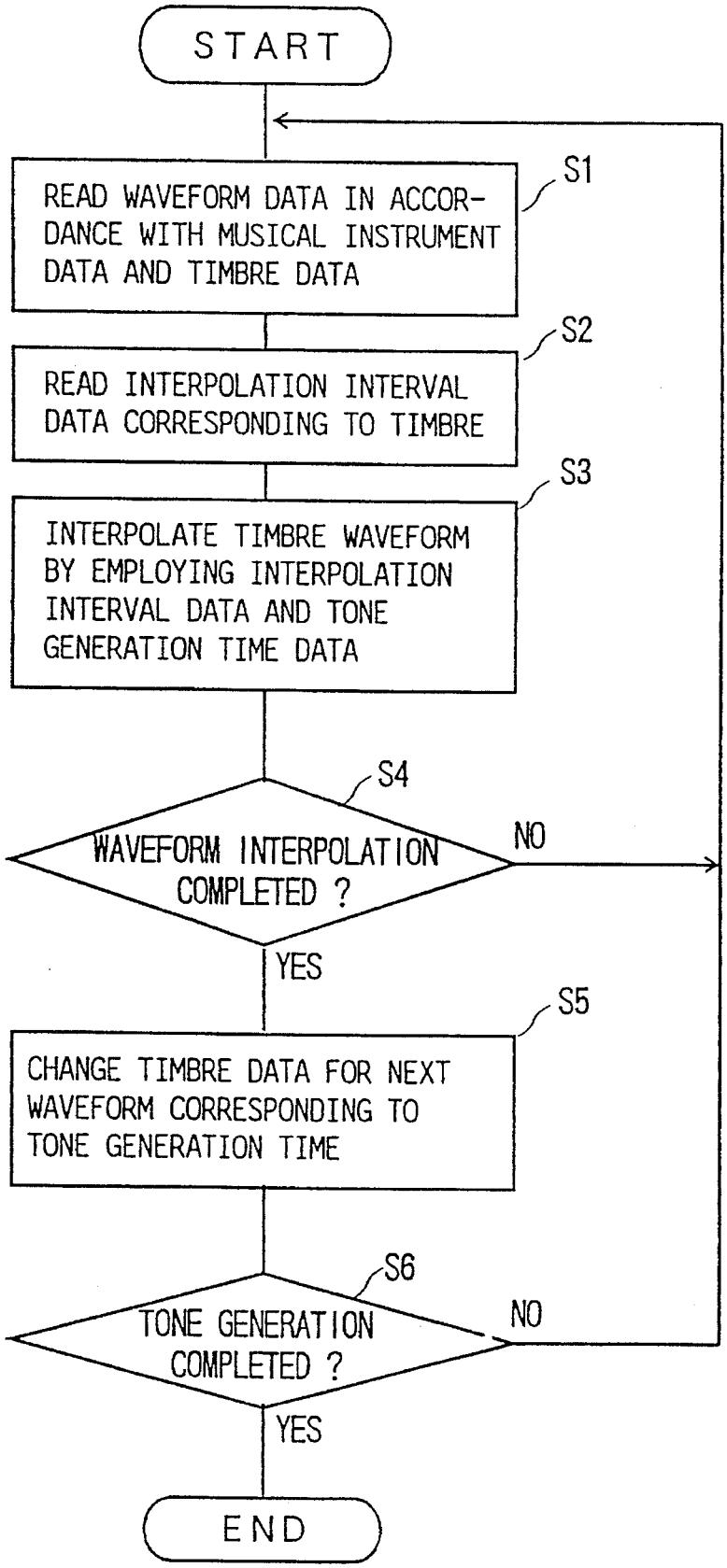
FIG. 6 is a flowchart showing a waveform interpolation process for the first embodiment of the electronic musical instrument of the present invention.

FIG. 6 is a flowchart showing the waveform interpolation processing of the electronic musical instrument of the present invention.

For this process, first, waveform data are read out (step S1). That is, waveform data are read from the waveform ROM 20 in accordance with musical instrument data, which are selected by panel switches, and timbre data, which correspond to the current tone generation time.

Then, interpolation interval data that correspond to a timbre are read from the interpolation interval ROM 21 (step S2).

Interpolation is performed on the read-out timbre waveforms by employing the interpolation interval data and the tone generation time data (step S3). The tone generation time data are data whose value is increased, each sampling, from keyboard key depression time 0 until the expiration of the time period designated by the interpolation interval data.

Sequentially, a check is performed to determine whether or not waveform interpolation for the interval has been completed (step S4). If it has not been completed, program execution returns to step S1 and the above described routine is repeated.

If, at step S4, the waveform interpolation has been completed, timbre data is altered for a succeeding wave that corresponds to the tone generation time (step S5).

A check is performed to determine whether or not tone generation has been completed (step S6). If it has not been completed, program control returns to step S1 and the above described procedures are repeated. If tone generation has been completed, this process is terminated.

Figure 7:
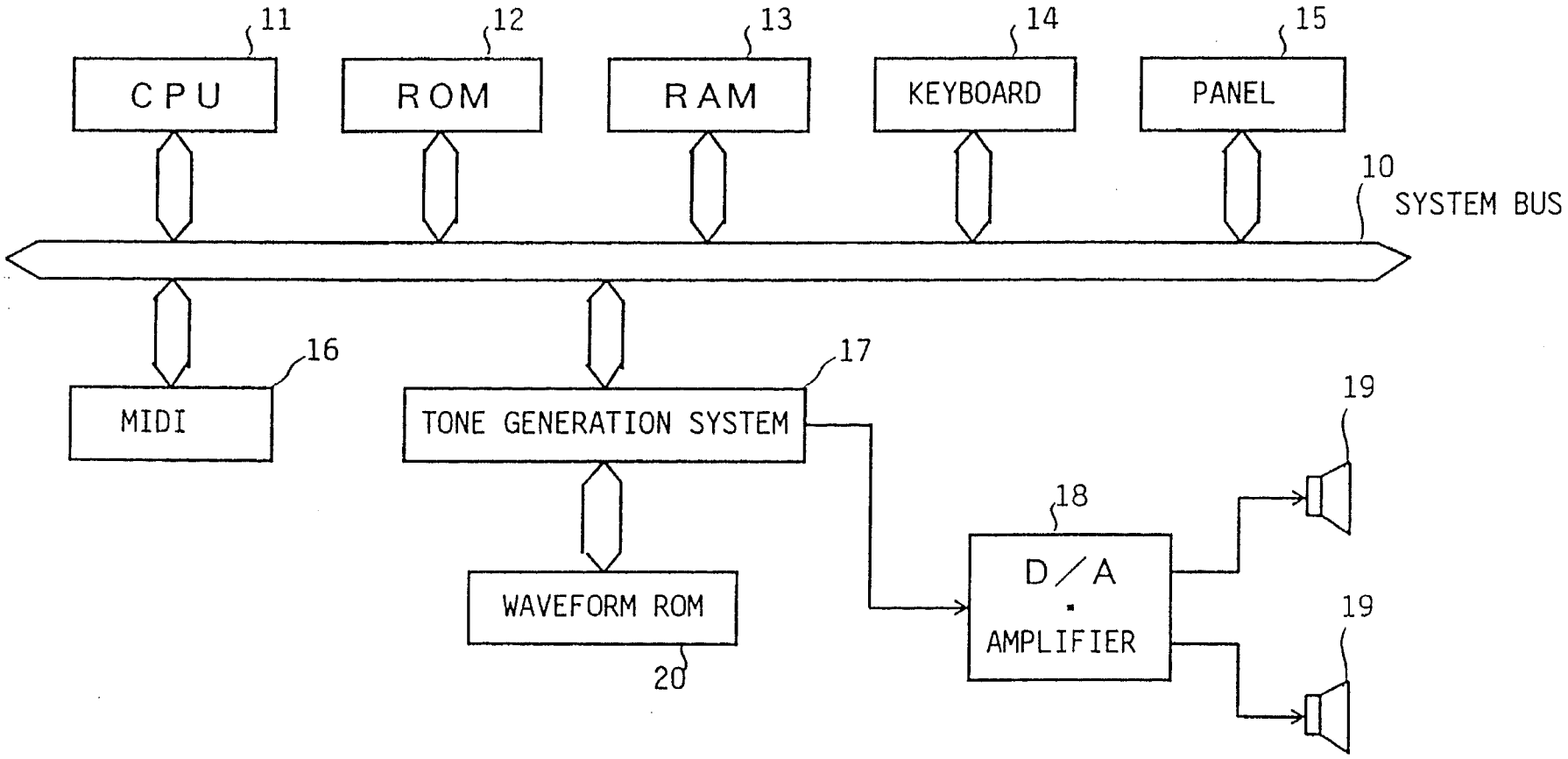
FIG. 7 is a schematic block diagram illustrating a second embodiment of an electronic musical instrument of the present invention.

The second embodiment of the present invention will now be described. FIG. 7 is a schematic block diagram illustrating the general structure of an electronic musical instrument having a tone generation system that can perform waveform interpolation at variable time intervals.

Since the essential arrangement and functions of an electronic musical instrument in this embodiment are the same as those in the first embodiment, which is shown in FIG. 1, only those features of the second embodiment that are different from those of the first embodiment will now be explained.

In a waveform ROM 20, which is connected to a tone generation system 17, are stored basic waves for the musical tones that are to be produced.

In the primary ROM 20, multiple types of waveform data that correspond to individual timbres are stored to provide multiple timbre types.

The waveform data stored in the waveform ROM 20 are read by the tone generation system 17. Looping is performed on the read waveform data so that musical tones can be sequentially produced.

The tone generation system 17 is a circuit that includes, for example, multiple oscillators. Upon the receipt of a tone generation parameter and a tone generation start command from a CPU 11, the tone generation system 17 reads waveform data that are stored in the waveform ROM 20, performs processing, such as waveform interpolation and envelope addition, and generates a digital tone signal.

The output of the tone generation system 17 is transmitted to loudspeakers 19, which function as a reproduction unit, via a digital/analog converter and amplifier 18. During its transmission, the output of the tone generation system 17 is converted to an analog signal, which is then amplified to a desired level. The resultant signal is output as an acoustic signal by the loudspeakers 19.

The tone generation system 17 that is structured as is described above also calculates interpolation intervals according to the linear principle.

Figure 8:
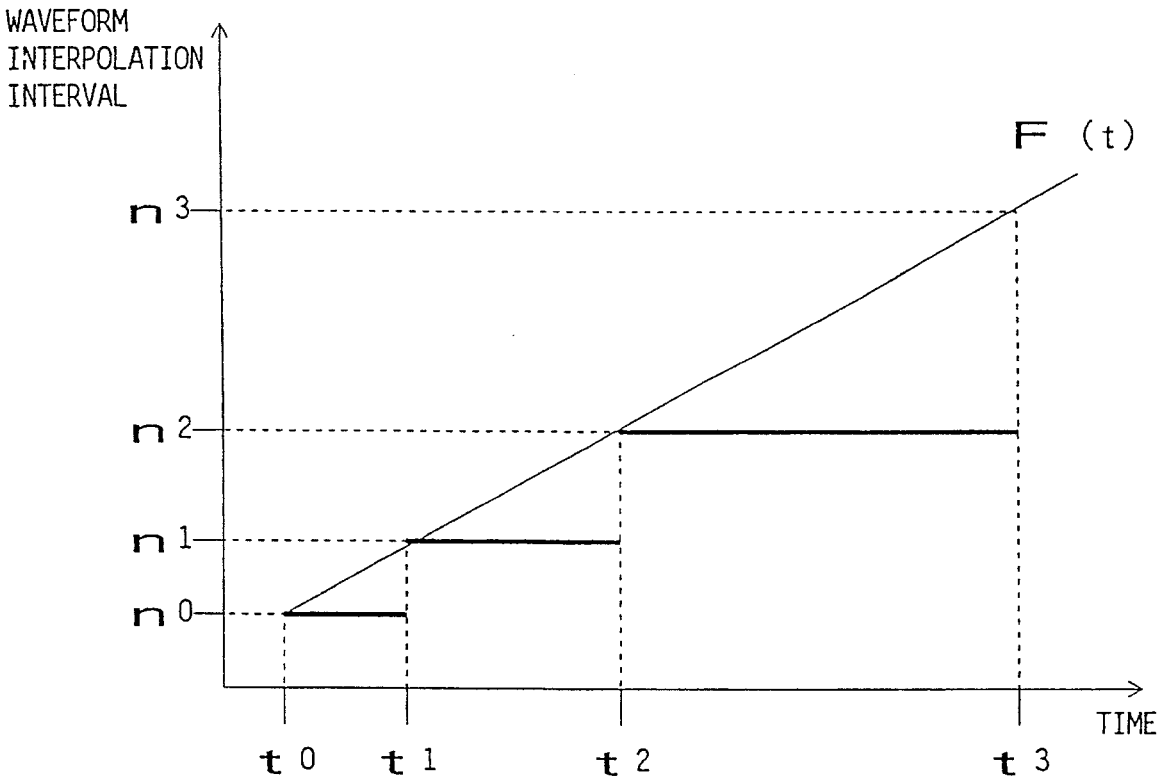
FIG. 8 is an explanatory diagram for computing waveform interpolation interval data in the second embodiment of an electronic musical instrument of the present invention.

The interpolation interval can be calculated as is shown in FIG. 8. For the linear function F(t) in FIG. 8, the horizontal axis represents the time and the vertical axis represents the waveform interpolation interval.

In this graph, the interpolation interval n0 is set at the initial time t0, so that t1=t0+n0, t2=t1+n1, and t3=t2+n2. As a result, interpolation interval data n0, n1, n2, and n3 are acquired by employing the linear principle.

The following explanation will mainly cover a waveform interpolation process for the electronic musical instrument having the above described arrangement.

Figure 9:
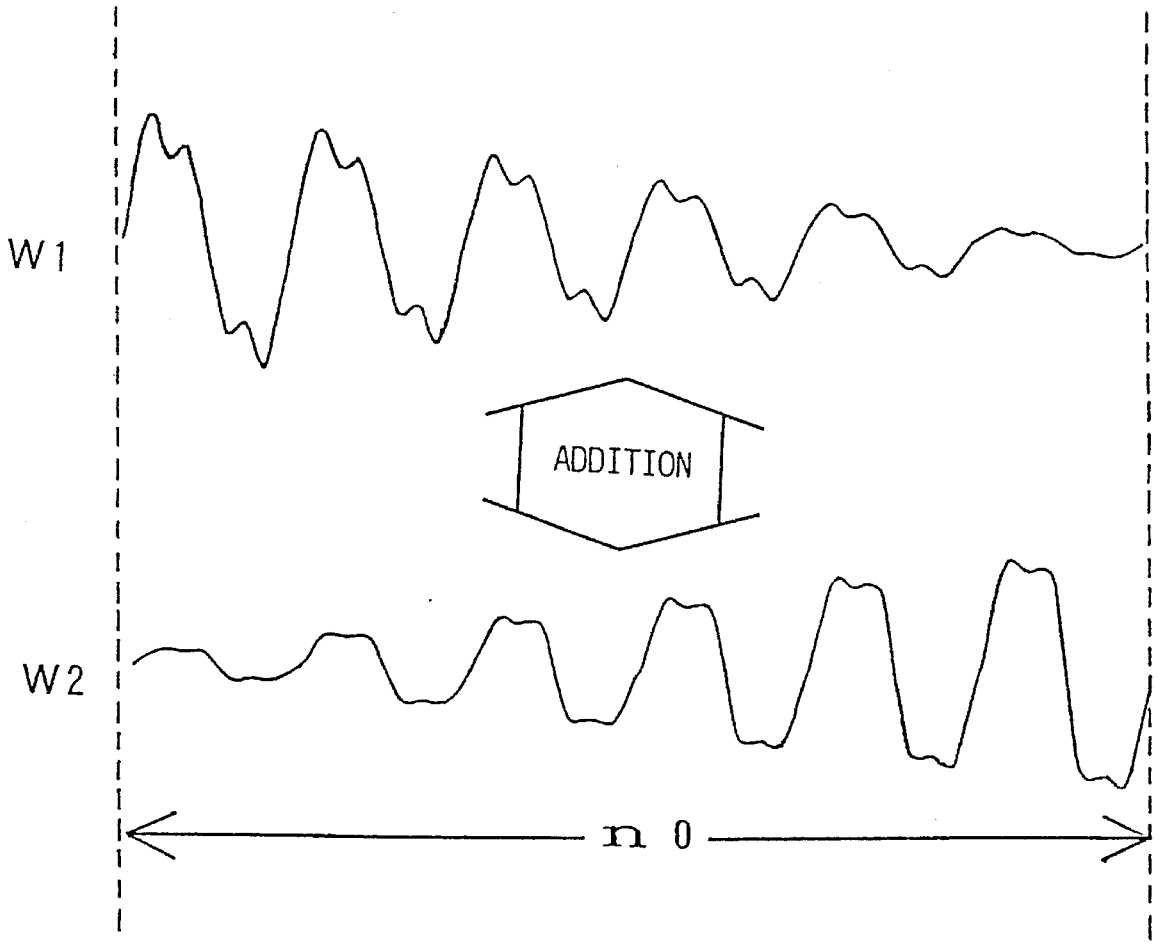
FIG. 9 is an explanatory diagram for the performance of a crossfade involving a preceding waveform and a succeeding waveform.

FIG. 9 is a diagram showing a crossfade wave shift during which a preceding wave W1 is replaced by a succeeding wave W2 within an interpolation interval n0.

While the preceding wave W1 is undergoing fade-out and the succeeding wave W2 is simultaneously undergoing fade-in, the two waves, W1 and W2, are added together to provide a smooth shift from the preceding wave W1 to the succeeding wave W2, i.e., to perform waveform interpolation.

When waveform interpolation is performed at variable intervals, the electronic musical instrument of the first embodiment employs the interval ROM 21 to store the interpolation interval data that are used by the tone generation system 17, to which is connected the waveform ROM 20, as is shown in the block diagram in FIG. 1.

In the configuration of the first embodiment, interpolation interval data that correspond to a change in waveform data are stored, and are then read out under the control of the CPU 11 and in consonance with the waveform data and the magnitude of the change in the waveform data.

Musical tones are generated in accordance with readout waveform data, and waveform interpolation is performed in consonance with interpolation interval data.

In the first embodiment, where the interval ROM 21, which serves as a storage means, is employed to perform interpolation, theoretically, a variety of interpolation interval data can be stored that make it possible to cope with a number of different situations.

In this instance, however, not only is the size of the interval ROM 21 expanded, but also the load on the CPU 11, which controls the entire system, and the load on the tone generation system 17 are increased. Further, as the speed at which individual components function must be increased for high speed processing, manufacturing costs rise accordingly.

The basis for the second embodiment therefore is the presumption that practically satisfactory waveform interpolation can be performed even if the interpolation interval data are incomplete.

That is, the second embodiment is based on the observation that, since the characteristics and the other factors of the components required for musical tone production are linear, Dearly satisfactory waveform interpolation can be performed in consonance with a variable amount of read-out waveform data.

Figure 10:
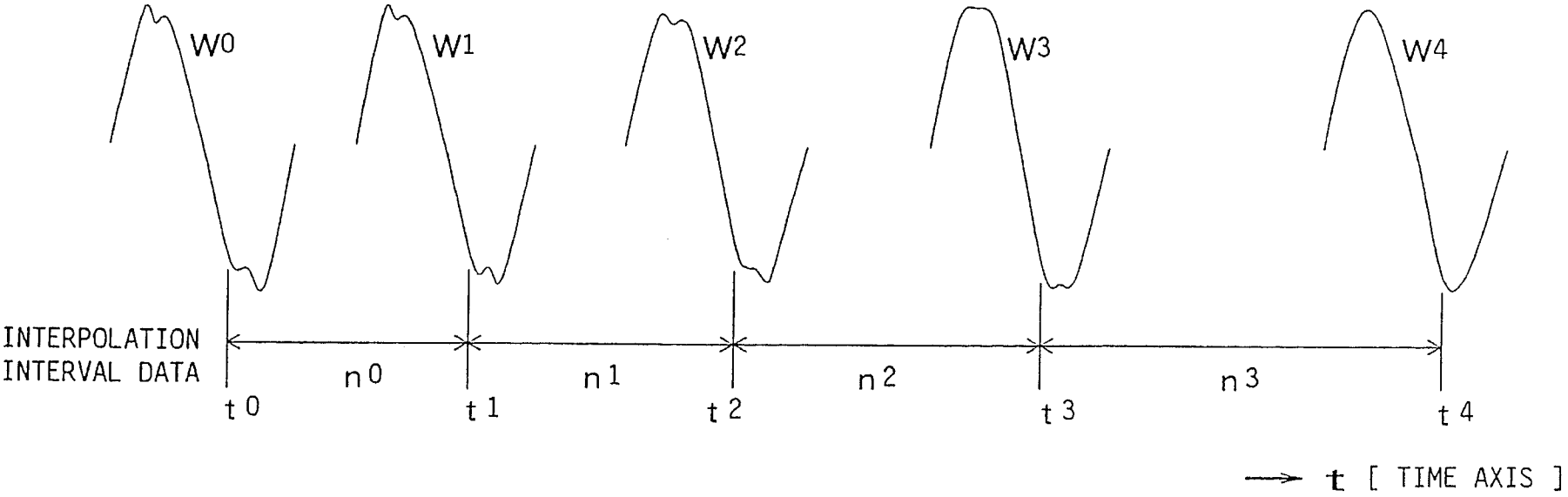
FIG. 10 is an explanatory diagram showing the interpolation stages between waveforms for the second embodiment of the electronic musical instrument of the present invention.

FIG. 10 shows the stages of waveform interpolation for the second embodiment. When waveform data, which have been calculated by using linear functions, are changed from W0, to W1, to W2, to W3, to W4, interpolation interval data that have been calculated by a linear function change from n0, to n1, to n2, to n3, each of which is different from the others.

The values of the interpolation interval data change in consonance with waveform changes, i.e., the magnitudes of the timbre changes.

As described above, in consonance with waveform data W0, W1, W2, W3, and W4, interpolation interval data nk, which correspond to the differences between preceding data values and succeeding data values, are calculated by, for example, the tone generation system 17.

Figure 11:
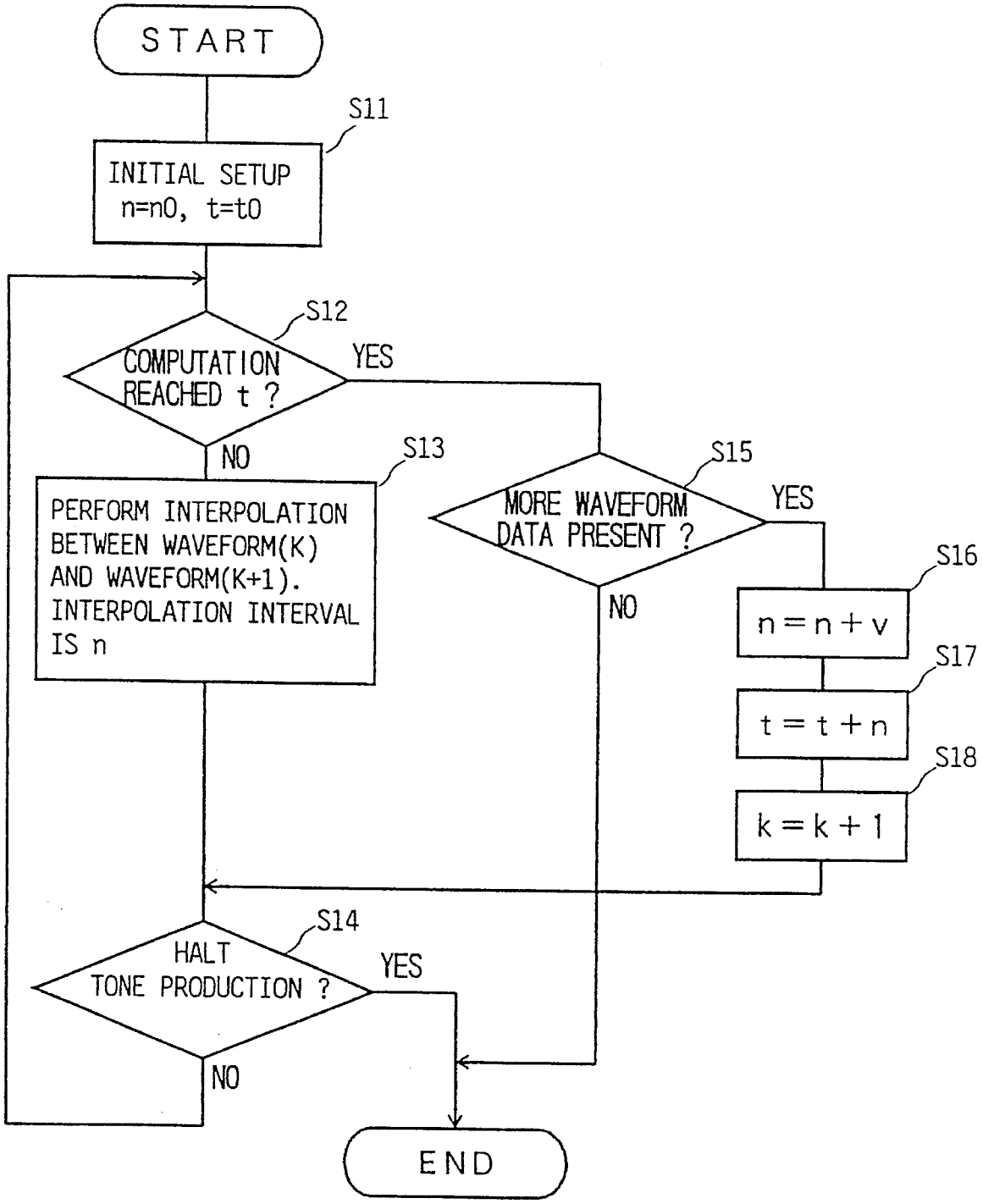
FIG. 11 is a flowchart showing a waveform interpolation process for the second embodiment of the electronic musical instrument of the present invention.

FIG. 11 is a flowchart showing the waveform interpolation processing for the electronic musical instrument of the second embodiment of the present invention. The initial setup is performed when waveform interpolation is begun (step S11.)

After the initial setup is completed, a check is performed to determine whether or not a calculated result has reached t (step S12). If not, waveform interpolation is performed between waveforms (k) and (k+1) (step S13). The interpolation interval in this case is n.

A check is then performed to determine whether or not tone generation should be halted (step S14). If it should not be halted, the procedures at and following step S12, where it is determined whether or not a calculated result has reached t, are repeated. If tone generation should be halted, the process is terminated.

If, at step S12, the calculated result has reached t, a check is performed to determine whether or not more waveform data remain (step S15). If there are no more waveform data, the process is terminated.

If there are remaining waveform data, procedures n=n+v (step S16), t=t+n (step S17), and k=k+1 (step S18) are performed, and program control moves down to step S14 where it is determined whether or not tone generation should be halted.

As previously described for the first embodiment, the electronic musical instrument has a storage means for holding interpolation interval data that correspond to the magnitudes of waveform changes, and performs optimal waveform interpolation, which is suited to the playing requirements, so as to produce musical tones. According to this invention, as waveform interpolation can be performed at time intervals that vary in consonance with the magnitudes of the changes in timbres, smoothly sounding musical tones can be produced that are nearly the same as musical tones produced by a natural musical instrument.

In addition, with the above described arrangement, the efficiency of tone waveform compression can be increased and the structure of an electronic musical instrument can be simplified.

As described above in detail for the second embodiment, an electronic musical instrument calculates interpolation interval data that correspond to the magnitudes of the changes of timbres, and produces musical tones while performing optimal waveform interpolation in consonance with playing requirements. Waveform interpolation is performed at time intervals that vary in accordance with the magnitudes of the changes of timbres, and smooth musical tones can be generated that sound nearly the same as those produced by a natural musical instrument.

Further, with this arrangement, the efficiency of tone waveform compression can be improved and the structure of an electronic musical instrument can be simplified.

Although the preferred embodiments of the present invention and the claims particularly point out the subject matter regarded as the invention, various other modifications are contemplated as being within the scope of the invention.

What is claimed is:

1. In an electronic musical instrument having a tone generating system that sequentially generates musical notes, improved means for smoothly changing timbre characteristics of a note or of the notes by providing a crossfade from a preceding timbre characteristic to a successive timbre characteristic by interpolation in a variable interpolation interval in which the preceding timbre characteristic overlaps the succeeding timbre characteristic, said means comprising:

waveform storage means for storing a selected number of sets of timbre characteristic waveform data;

means for selecting waveform data corresponding to timbre characteristics for a note or notes being generated by the instrument and for sequentially reading out same from said waveform storage means to form the preceding timbre characteristic waveform data and the succeeding timbre characteristic waveform data of the timbre characteristic changes;

interpolation interval storage means for storing interval data for interpolation between preceding and succeeding timbre characteristics forming timbre characteristic changes, said storage means providing interpolation interval data corresponding to timbre characteristic changes;

means for performing interpolation between preceding timbre characteristic waveform data and succeeding timbre characteristic waveform data for a given timbre characteristic change read from said waveform storage means in consonance with said interval data provided by said interpolation interval storage means for the given timbre characteristic change; and means for applying timbre characteristics corresponding to the interpolated timbre characteristic waveform data to the note or notes being generated by the tone generating system of the instrument.

2. The improved crossfade providing means according to claim 1 wherein said waveform storage means is further defined as storing waveform data corresponding to the notes that can be produced by the instrument and to the desired timbre characteristics for the notes.

3. The improved crossfade providing means according to claim 1 wherein said waveform storage means stores musical note waveform data, and wherein said crossfade providing means further includes looping means performing a looping process on said musical note waveform data, so as to cause the tone generating system to sequentially produce musical notes.

4. The improved crossfade providing means according to claim 1 wherein the electronic musical instrument has a central processing unit and wherein said selecting and reading out means, said interpolation performing means, and said applying means are controlled by the central processing unit.

5. In an electronic musical instrument having a tone generating system that sequentially generates musical notes, improved means for smoothly changing timbre characteristics of a note or of the notes by providing a crossfade from a preceding timbre characteristic to a successive timbre characteristic by interpolation in a variable interpolation interval in which the preceding timbre characteristic overlaps the succeeding timbre characteristic, said means comprising:

waveform storage means for storing a selected number of sets of timbre characteristic waveform data;

means for selecting waveform data corresponding to timbre characteristics for a note or notes being generated by the instrument and for sequentially reading out same from said waveform storage means to form the preceding timbre characteristic waveform data and the succeeding timbre characteristic waveform data of the timbre characteristic changes;

interpolation interval determining means for determining, by interpolative calculation, an interpolation interval for preceding and succeeding timbre characteristics that form a given timbre characteristic change;

means for performing interpolation between said preceding timbre characteristic waveform data and succeeding timbre characteristic waveform data from said waveform storage means in said interpolation interval determined by said determining means; and means for applying timbre characteristics corresponding to the interpolated timbre characteristic waveform data to the note or notes being generated by the tone generating system of the instrument.

6. The improved crossfade providing means according to claim 5 wherein said waveform storage means is further defined as storing waveform data corresponding to the notes that can be produced by the instrument and to the desired timbre characteristics for the notes.

7. The improved crossfade providing means according to claim 5 wherein said waveform storage means stores musical note waveform data, and wherein said crossfade providing means further includes looping means performing a looping process on said musical note waveform data, so as to cause the tone generating system to sequentially produce musical notes.

8. The improved crossfade providing means according to claim 5 wherein the electronic musical instrument has a central processing unit and wherein said selecting and reading out means, said interpolation interval determining means, said interpolation performing means, and said applying means are controlled by the central processing unit.

* * * * *